US007118314B2

(12) United States Patent
Zhou et al.

(10) Patent No.: US 7,118,314 B2
(45) Date of Patent: Oct. 10, 2006

(54) PALLET SYSTEM

(75) Inventors: Zhendong (Mike) Zhou, Mequon, WI (US); Jeffrey H. Bailey, Oak Creek, WI (US)

(73) Assignee: Oshkosh Truck Corporation, Oshkosh, WI (US)

( * ) Notice: Subject to any disclaimer, the term of this patent is extended or adjusted under 35 U.S.C. 154(b) by 0 days.

(21) Appl. No.: 10/923,231

(22) Filed: Aug. 20, 2004

(65) Prior Publication Data

US 2006/0039771 A1 Feb. 23, 2006

(51) Int. Cl.
*B60P 7/08* (2006.01)

(52) U.S. Cl. ..... 410/84; 410/46; 410/80; 410/92

(58) Field of Classification Search ..... 410/46, 410/77, 80, 84, 92, 89, 130, 132, 134, 137–139; 414/536; 108/57.15, 55.1, 55.3, 64, 50.11; 244/118.1, 137.1; 248/346.03, 346.07
See application file for complete search history.

(56) References Cited

U.S. PATENT DOCUMENTS

RE27,034 E * 1/1971 Bezlaj ..... 410/54
3,602,474 A * 8/1971 Deering et al. ..... 410/84
4,696,609 A * 9/1987 Cole ..... 410/69
5,573,360 A * 11/1996 Bennett ..... 410/84
5,799,585 A 9/1998 Brennan, Jr. et al.
5,983,806 A 11/1999 Brennan, Jr. et al.
6,315,141 B1 11/2001 Brennan, Jr.
6,427,947 B1 8/2002 Rohrlick et al.
6,695,554 B1 * 2/2004 Afful ..... 410/80
2003/0021660 A1 1/2003 Wells

OTHER PUBLICATIONS

Boehing, "The Slipper Adapter Pallet", Mar. 2002, (2 pgs.).
Sea Box, Inc., Enhanced Delivery System Air-Platform EDS-A General Description, (undated), (2 pgs.).

* cited by examiner

*Primary Examiner*—Stephen Gordon
(74) *Attorney, Agent, or Firm*—Foley & Lardner LLP

(57) ABSTRACT

A pallet system for supporting and transporting cargo on a cargo carrier. The cargo carrier has a plurality of rollers and a pair of retaining rails. The pallet system comprises a pallet member having a top late and a bottom plate, with each plate maintained in a spaced apart relationship to define an interior space. A pair of pallet extension members reciprocally mounted in the interior space. One extension member is mounted a spaced distance from the other extension member, with each pallet extension member having an outer edge configured to engage the retaining rails. An extension mechanism is mounted in the interior space and coupled to the pallet member and the pallet extensions. The extension mechanism moves each pallet extension member from a first position to a second position.

11 Claims, 3 Drawing Sheets

PALLET SYSTEM

BACKGROUND OF THE INVENTION

The present invention relates to pallets and, more particularly, to a pallet system for supporting and transporting cargo on a cargo carrier.

Cargo carriers, especially aircraft cargo carriers, typically transport cargo on transport flat racks, container roll in/out platforms and ISO container loads. However, such devices need to be placed on standard pallets known as a 463L pallet. Such 463L pallets, with their respective cargo loads, are then handled by material handling equipment such as a K-loader for loading and unloading an aircraft. The aircraft typically have a plurality of rollers which facilitate movement of the pallets in and out of the aircraft. The aircraft are also provided with at least a pair of retaining rails mounted typically along the longitudinal length of the fuselage of the aircraft. The retaining rails engage the 463L pallets to secure the pallets in a given location in the fuselage. Such retention is critical to stability of the aircraft in flight as well as in balancing the cargo loads on the pallets.

Cargo transport aircraft or other cargo carriers typically vary in width. For instance, a military transport such as a C-130 aircraft accommodates one row of pallets having a width of approximately 108 inches. A military cargo aircraft such as a C-17 can handle two rows of pallets having width of approximately of 88 inches or alternatively one row of pallets having width of approximately 108 inches. Other cargo carriers, such as trucks and water craft may accommodate pallets of different widths. Existing pallet systems for use with cargo carriers typically are provided in a single width, for example, 463L type pallets can be 88 inches or 108 inches wide, which limits their use to a particular type of cargo carrier or aircraft.

Thus, there is a need for a pallet system for supporting and transporting cargo on a cargo carrier wherein the distance between the outer edges of the pallet are infinitely adjustable. There is further a need for a pallet system where the distance between the outer edges is 88 inches at a first position and 108 inches at a second position. There is an additional need for a pallet system for supporting and transporting cargo in which two or more pallet members can be coupled together to accommodate a given cargo load.

SUMMARY OF THE INVENTION

There is provided a pallet system for supporting and transporting cargo on a cargo carrier. The cargo carrier has a plurality of rollers and a pair of retaining rails. The pallet system comprises a pallet member having a top plate and a bottom plate, with each plate maintained in a spaced apart relationship to define an interior space. A pair of pallet extension members are reciprocally mounted in the interior space. One extension member is mounted a spaced distance from the other extension member, with each pallet extension member having an outer edge configured to engage the retaining rails. An extension mechanism is mounted in the interior space and coupled to the pallet member and the pallet extensions. The extension mechanism moves each pallet extension member from a first position to a second position. Another embodiment of the pallet system includes a second extension mechanism mounted in the interior space, with one extension mechanism coupled to the pallet extensions on one side of the pallet member and the second extension mechanism coupled to the pallet extensions on another side of the pallet member.

There is further provided an aircraft pallet system for supporting and transporting cargo on a cargo aircraft. The aircraft has a plurality of rollers and a pair of retaining rails. The aircraft pallet system comprises a pallet member having a top plate and a bottom plate, with each plate maintained in a spaced apart relationship to define an interior space. A pair of pallet extension members are reciprocally mounted in the interior space, with one extension member mounted a spaced distance from the other extension member. Each pallet extension member has an outer edge configured to engage the retaining rails. An extension mechanism is mounted in the interior space and coupled to the pallet member and the pallet extensions. The extension mechanism moves each pallet extension member from a first position to a second position. Another embodiment of the aircraft pallet system includes a second extension mechanism mounted in the interior space, with one extension mechanism coupled to the pallet extensions on one side of the pallet member and the second extension mechanism coupled to the pallet extensions on another side of the pallet member.

DETAILED DESCRIPTION OF THE EXEMPLARY EMBODIMENTS

Figure 1:
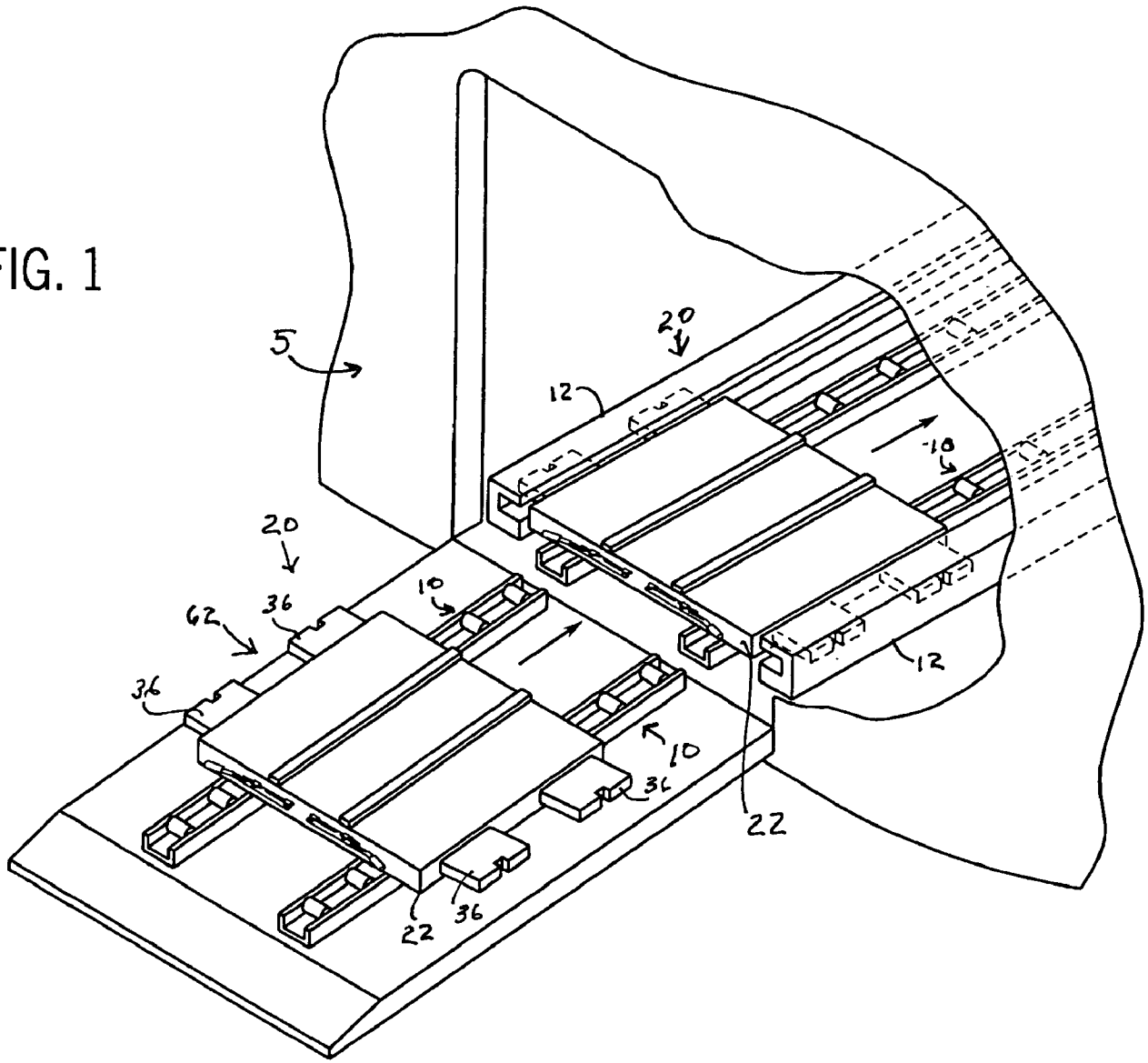
FIG. 1 is a perspective view of an exemplary embodiment of a pallet system for supporting and transporting cargo on a cargo carrier, with one pallet member engaged with the retaining rails and another pallet member on rollers to move into the cargo carrier.

Referring to the figures, FIG. 1 illustrates a cargo carrier 5 having a plurality of rollers 10 and a pair of retaining rails 12. Rollers 10 are typically mounted in the floor portion of the cargo carrier and are used to facilitate movement of cargo and pallets from one location to another within the cargo carrier 5. One example of a cargo carrier 5 is an aircraft such as a C-17 or a C-130 cargo aircraft. The fuselage of the aircraft typically has a cargo compartment located within the fuselage with a deck extending generally throughout the cargo compartment and typically includes a cargo ramp system. The cargo ramp system is positionable in a fully closed position or a fully open position and various intermediate positions. The rollers 10 are typically disposed within the cargo compartment and on the cargo ramp and may be pivotably journaled to a track. Cargo pallets typically are rolled over the plurality of rollers 10 and into position for transport. The retaining rails 12 are then used to secure the cargo into position.

As illustrated in FIG. 1, a pallet system 20 includes a pallet member 22. The pallet member 22 has a top plate 24 and a bottom plate 26 with each plate 24, 26 maintained in a spaced apart relationship to define an interior space 30. (See FIG. 6.) The side portions 28 which separate the top plate 24 and the bottom plate 26 can be of any suitable dimension that is compatible with the type of cargo carrier 5 selected by a user.

A pair of pallet extension members 36 are reciprocally mounted in the interior space 30, with one extension member 36 mounted a spaced distance from the other extension member 36. Each pallet extension member 36 has an outer edge 38 configured to engage or be engaged by the retaining rails 12. (See FIG. 1.)

Figure 2:
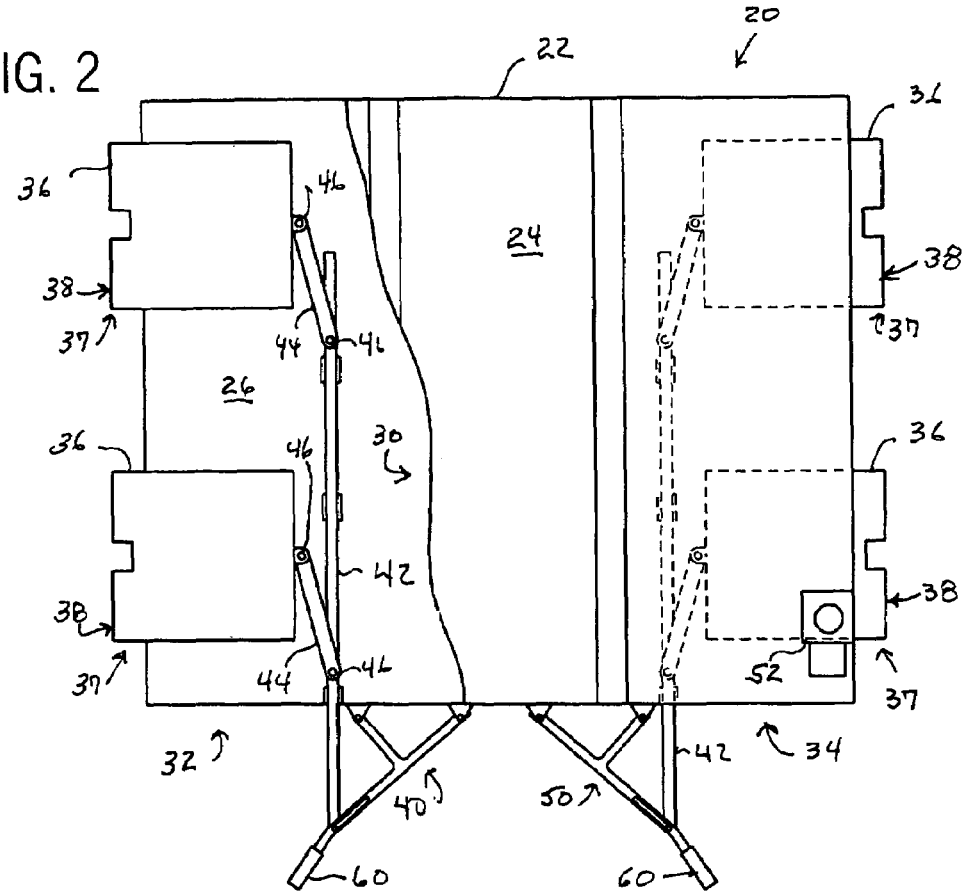
FIG. 2 is a top view of an exemplary embodiment of a pallet system pallet member illustrating two pair of pallet extension members coupled to two extension mechanisms, with the outer edges of the pallet extension members in a first position.
Figure 3:
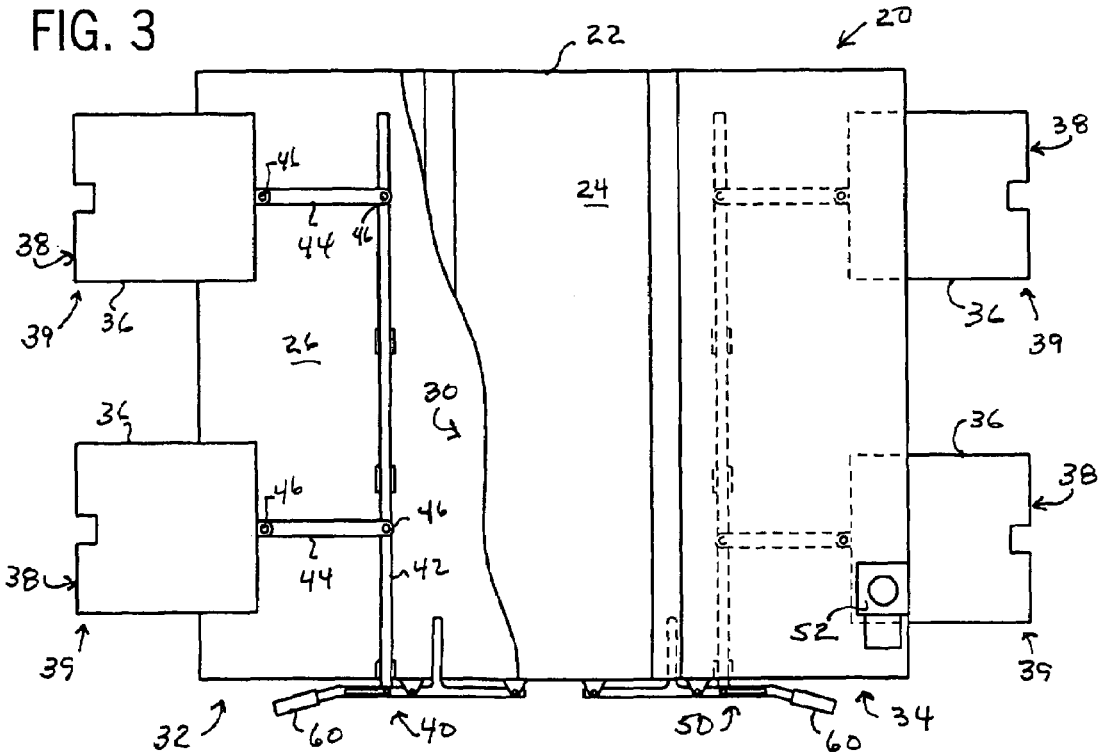
FIG. 3 is a top view of an exemplary embodiment of a pallet system pallet member illustrating two pair of pallet extension members coupled to two extension mechanisms, with the outer edges of the pallet extension members in a second position.
Figure 4:
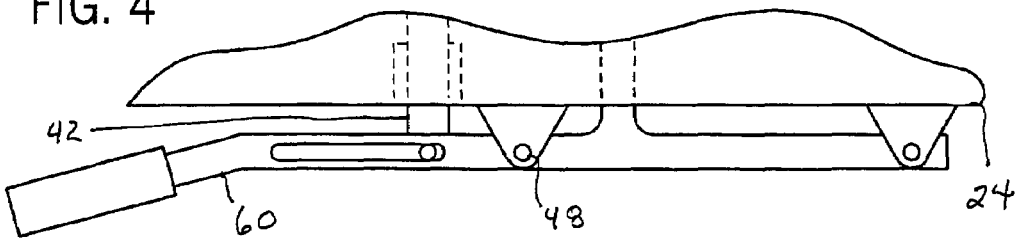
FIG. 4 is a top view of an exemplary embodiment of an actuator coupled to an extension mechanism of a pallet system pallet member, with the extension mechanism locked in the second position illustrated in FIG. 3.
Figure 5:
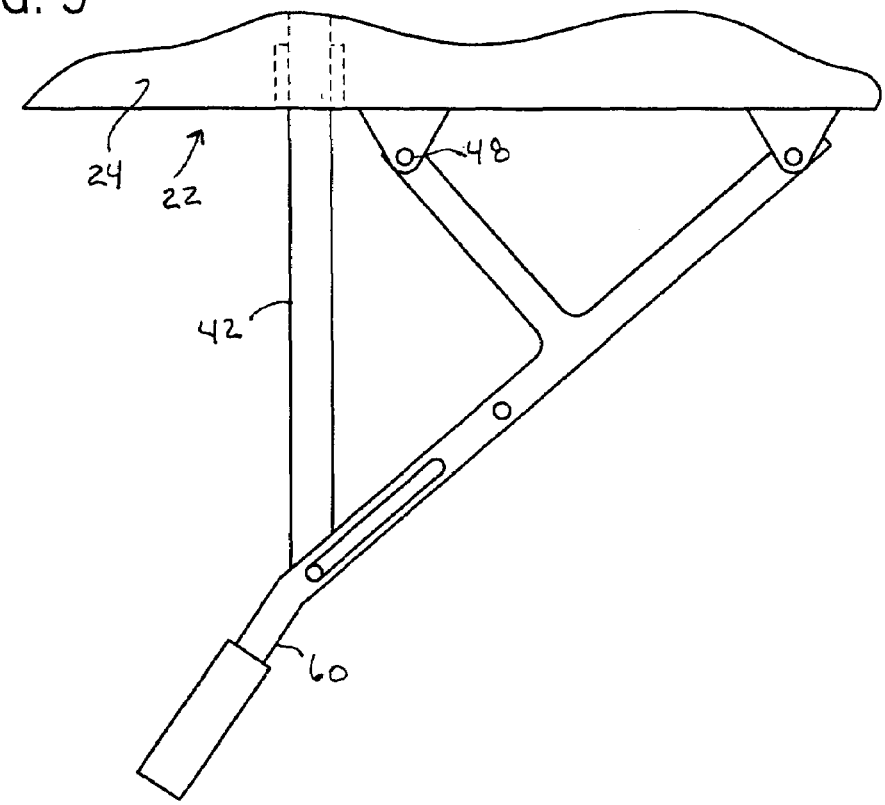
FIG. 5 is a top view of an exemplary embodiment of an actuator coupled to an extension mechanism of a pallet system pallet member, with the extension mechanism locked in the first position illustrated in FIG. 2.
Figure 6:
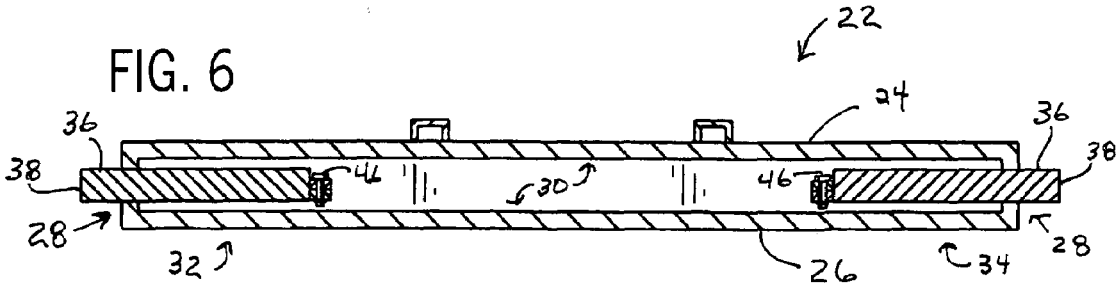
FIG. 6 is a sectional view of an exemplary embodiment of a pallet member.

FIGS. 2, 3 and 6 illustrate exemplary embodiments of a pallet member 22 having two pairs of pallet extension members 36. It should be understood that any number of pallet extension members 36 can be configured for use in the pallet member 22 as determined by manufacturer and user of the pallet system 20.

An extension mechanism 40 is mounted in the interior space 30 and coupled to the pallet member 22 and the pallet extensions 36. The extension mechanism moves each pallet extension member 36 from a first position 37 to a second position 39. FIG. 2 illustrates an exemplary embodiment of the pallet system 20 pallet member 22 with four pallet extension members 36 in a first position. FIG. 3 is an illustration of an exemplary embodiment of a pallet system 20, pallet member 22 with four pallet extension members 36 in a second position 39.

In the illustrated exemplary embodiments, the pallet extension members 36 are configured with two pallet extension members 36 coupled to the extension mechanism 40 and an additional pair of pallet extension members 36 coupled to a second extension mechanism 50.

Each extension mechanism 40, 50 includes an extension rod 42 which extends through the interior space 30 of the pallet member 22. A lever member 44 is coupled with a lever pin 46 to the extension rod 42 and to each pallet extension member 36. The extension rod 42 of the extension mechanism 40 can be slidingly mounted in a series of supports that couple the extension mechanism 40 to the pallet member 22 and facilitate the movement of the extension rod 42 to a selected position. The extension mechanism 40, 50 can be infinitely positioned between a first position 37 and a second position 39 to accommodate the spacing distance between retaining rails 12 in a selected cargo carrier 5. For example, for a C-17 military cargo aircraft, the distance between the outer edges 38 of the pallet extension members 36 are a nominal 88 inches at a first position 37. For use of the pallet member 22 in a C-130 military cargo aircraft type, cargo carrier 5, the outer edges 38 of the pallet extension members 36 and the pallet member 22 are a nominal 108 inches in a second position 39.

It is also contemplated that a second pallet member 62 can be coupled to the pallet member 22 to support a specific cargo load, for example, an ISO container or a container roll-in/roll-out platform. A rigid or flexible coupling can be used to connect the pallet member 22 and second pallet member 62. The length of the coupling is variable and depends on the distance between pallet members. The coupling can consist of one or more sections.

Each pallet member 22 of the pallet system 20 includes a cargo lock 52 to lock the cargo to the top plate 24 of the pallet member 22. It is contemplated that a plurality of cargo locks may be necessary to secure a given cargo load to the pallet member 22. An exemplary embodiment of a cargo lock 52 is one that is compatible with an ISO container. A cargo lock can also be an eyelet or hook to which chains or rigging can be attached to secure a cargo load to the pallet member 22.

Each extension mechanism 40, 50 is coupled to an actuator 60. Each extension mechanism 40 and 50 can be operated independently of each other or they can be operated as a single, integrated mechanism. The actuator 60 can be a handle as illustrated in FIGS. 2–5. It is also contemplated that the actuator can be an electric, pneumatic, and hydraulic motor, coupled with appropriate gear trains, to the extension rod 42.

Each pallet member 22 is composed of suitable material such as metal (steel) or a composite material of sufficient strength and resiliency for supporting and transporting cargo. It is further contemplated that the pallet system 20 can be used in facilities where a large crane is not available for removing the cargo from the cargo carrier.

Thus, there is provided a pallet system for supporting and transporting cargo in a cargo carrier. The embodiments illustrated in the figures and described above, are presently preferred, but it should be understood that these embodiments are offered by way of example only. The invention is not intended to be limited to any particular embodiment but is intended to extend to various modifications that nevertheless fall within the scope of the appended claims. Additional modifications will be evident to those with ordinary skill in the art.

What is claimed is:

1. An aircraft pallet system for supporting and transporting cargo on an aircraft, the aircraft pallet system comprising:

a pair of retaining rails configured to be spaced apart at a first distance when coupled to a first aircraft and configured to be spaced apart at a second distance when coupled to a second aircraft;

a pallet having a top and a bottom maintained in a spaced apart relationship;

a pair of engagement members slidably extendable and retractable from between the top and the bottom to engage the retaining rails; and an extension mechanism coupled to the pallet and the engagement members and operable to adjust a position of the engagement members to fit the retaining rails spaced apart at the first distance when used in the first aircraft and to fit the retaining rails spaced apart at the second distance when used in the second aircraft.

2. The aircraft pallet system of claim 1, including at least one additional pair of engagement members slidably extendable and retractable from between the top and the bottom.

3. The aircraft pallet system of claim 1, wherein the extension mechanism includes an extension lock configured to lock the extension mechanism.

4. The aircraft pallet system of claim 1, wherein the position of the engagement members is adjustable between a plurality of distances between the first distance and the second distance.

5. The aircraft pallet system of claim 4, wherein the first distance is substantially 88 inches and the second distance is substantially 108 inches.

6. The aircraft pallet system of claim 1, including a second pallet coupled to the first mentioned pallet.

7. The aircraft pallet system of claim 1, including a cargo lock configured to lock cargo to the top of the pallet.

8. The aircraft pallet system of claim 2, including a second extension mechanism, with the first mentioned extension mechanism coupled to one of the pairs of engagement members on one side of the pallet and the second extension mechanism coupled to the other pair of engagement members on another side of the pallet.

9. The aircraft pallet system of claim 8, wherein the first mentioned extension mechanism is operated independently of the second extension mechanism.

10. The aircraft pallet system of claim 9, including an extension lock for each extension mechanism.

11. The aircraft pallet system of claim 1, including an actuator coupled to the extension mechanism.

* * * * *